US005279011A

United States Patent [19]

Schnelle

[11] Patent Number: 5,279,011

[45] Date of Patent: Jan. 18, 1994

[54] OPERATION TABLE WITH REMOVABLY MOUNTED PATIENT SUPPORT SURFACE MEANS

[75] Inventor: Eberhard Schnelle, Rastatt, Fed. Rep. of Germany

[73] Assignee: Stierlen-Maquet AG, Rastatt, Fed. Rep. of Germany

[21] Appl. No.: 977,923

[22] Filed: Nov. 18, 1992

[30] Foreign Application Priority Data

Nov. 21, 1991 [DE] Fed. Rep. of Germany ..... 4138319

[51] Int. Cl.[5] ..... A61G 13/00

[52] U.S. Cl. ..... 5/616; 5/620

[58] Field of Search ..... 5/600, 613, 616, 620

[56] References Cited

U.S. PATENT DOCUMENTS 3,362,704 1/1968 Pilz ..... 5/616 X 3,754,749 8/1973 Lyon et al. ..... 5/616 X 4,101,120 7/1978 Seshima ..... 5/611

4,592,104 6/1986 Foster et al. ..... 5/616

4,795,142 1/1989 Schaefer ..... 5/620

5,083,331 1/1992 Schnelle et al. ..... 5/100

*Primary Examiner*—Michael F. Trettel

[57] ABSTRACT

In an operating table with a support column (2) and a patient support surface means (14) removably mounted on the support surface, which patient support surface means includes a base section (16) releasably connectable with the support column (12) and at least one further support surface section (18) pivotally connected therewith, and having a drive mechanism for adjusting the further support surface section (18) relative to the base section (16), the drive mechanism being an electric motor drive unit (34, 44, 46) on the patient support surface means (14).

9 Claims, 2 Drawing Sheets

OPERATION TABLE WITH REMOVABLY MOUNTED PATIENT SUPPORT SURFACE MEANS

Figure 1:
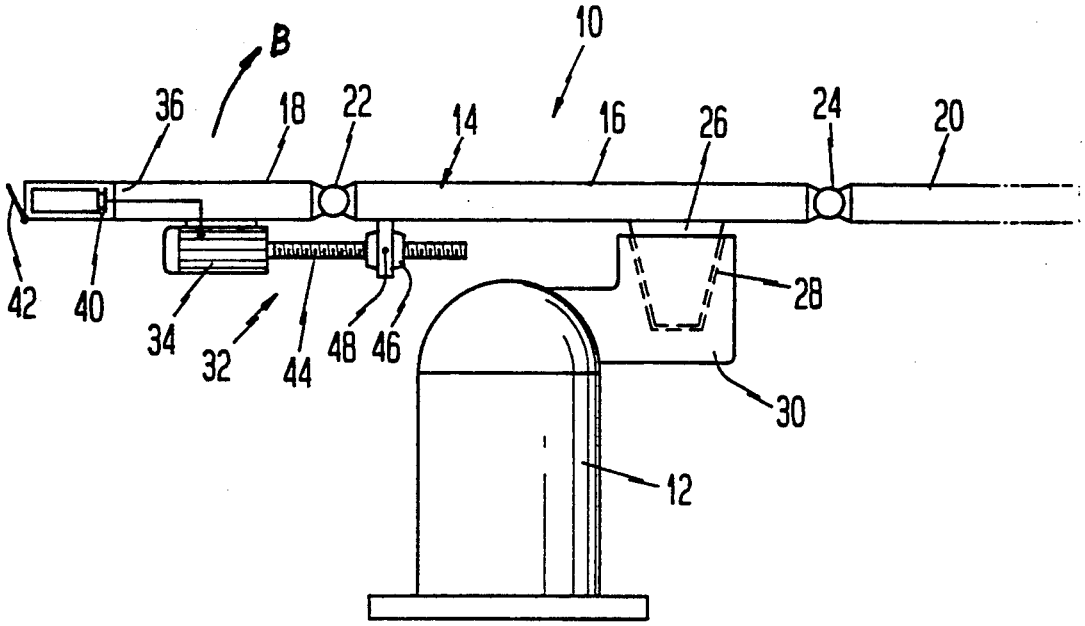

The invention concerns an operating table with a support column and with a patient support surface means removably mounted on the support column, which support surface means includes a base section releasably connectable with the support column and at least one further support surface section pivotally connected therewith, and having a drive mechanism for adjusting the further support surface section relative to the base section.

An operating table of the previously described kind is known from German Patent 1,196,815. The drive mechanism for adjustment of the support surface sections relative to one another include in this case an electric motor arranged in the support column which is connected with the individual support surface sections by means of drive trains, with support surface sided and column sided coupling elements being provided at the transition between the patient support surface means and the support column, which coupling elements upon placement of the patient support surface means onto the support surface come into cooperable engagement with one another.

A disadvantage of this solution is that it is almost impossible to make such couplings effectively sterile. A further disadvantage resides in that the support surface sections of the patient support surface can only be adjusted when the support surface means is connected with the support column.

The invention has as its object the provision of an operating table of the aforementioned kind whose sterilizability is not impaired by the motorized adjustability of the support surface sections.

This object is solved in accordance with the invention in that the drive mechanism is an electric motor drive unit arranged on the patient support surface means. This therefore presents the possibility that the electric motor is connectable to a voltage source separate from the patient support surface means by column sided and support surface sided electric contact elements provided at the transition between the support column and the patient support surface means and which contact elements upon placement of the patient support surface means onto the support column come into contact with one another. Another possibility for the delivery of energy to the electric motor resides in that a battery feeding the motor is arranged on the patient support surface means. The first solution has the advantage that the electric motor is practically speaking connectable to the electric mains. The second solution has the advantage that such contact elements between the patient support surface means and the support column can be used as to preclude an explosion danger because the creation of sparks is avoided, and also that the sections of the patient support surface means can be adjusted when the patient support surface means is separated from the support column. The previously described explosion danger can above all things also be reliably reduced if the electric motor is inductively coupled with a voltage source in the support column. Also, the battery can be so arranged that it is inductively connected with a charging device arranged inside of the support column when the patient support surface means rests on the support column. This assures that the battery is always charged when the patient support surface is removed from the support column.

Preferably, the electric motor drive unit and the battery are arranged on an adjustable section of the patient support surface means, for example on the patient support section forming the support for a patient's back. Practically, batteries are used which are tightly sealed against bacteriological organisms and which can be disinfected and present no problem in the sterilization and disinfection of the table. Further, they are protected against X-rays and disturb nothing in the taking of X-ray pictures.

Figure 2:
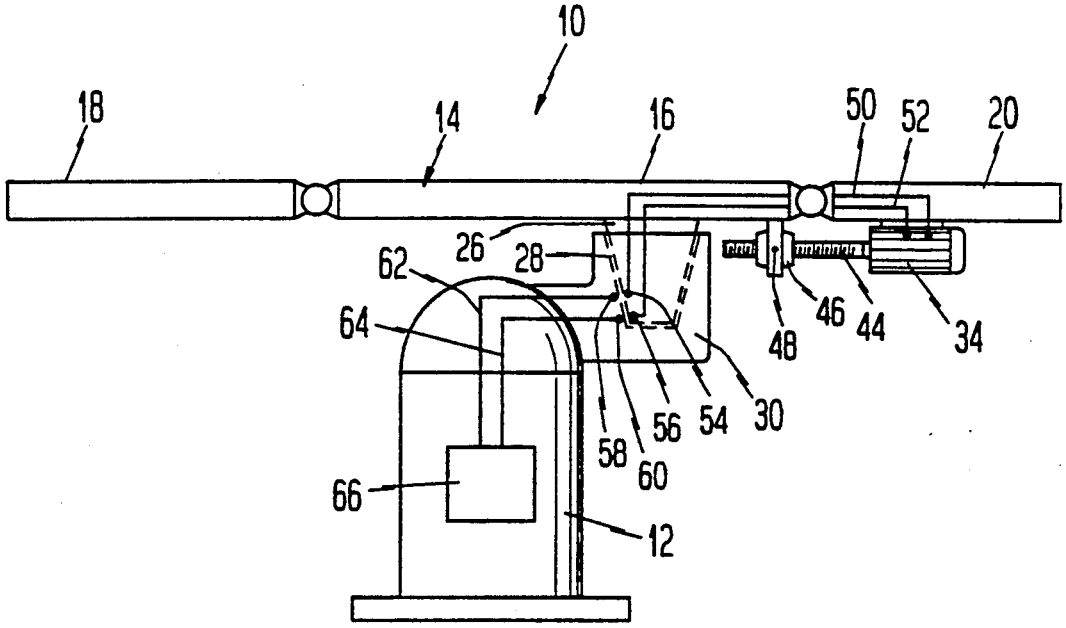
Figure 3:
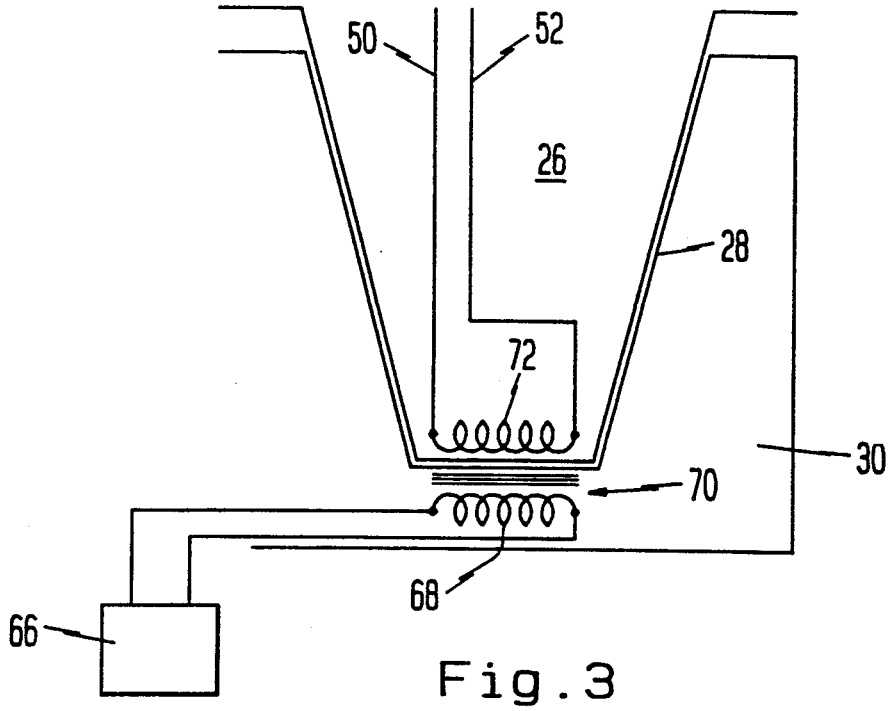
Figure 4:
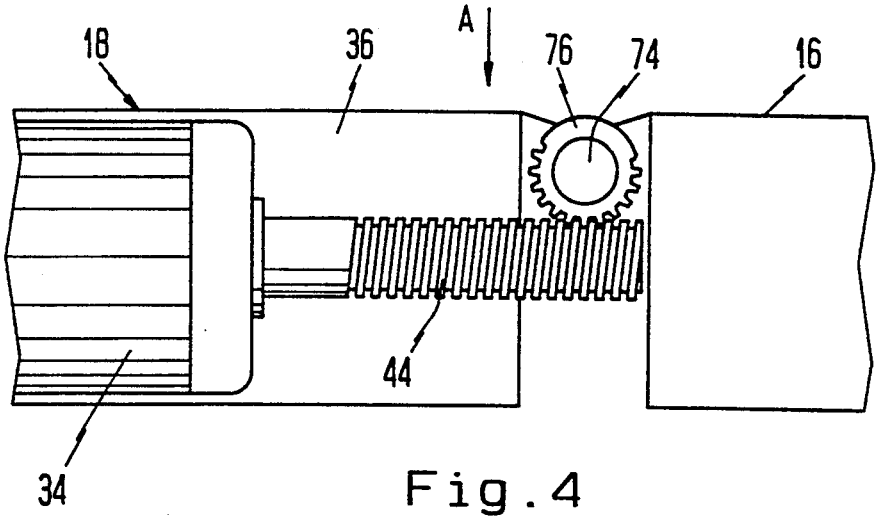
Figure 5:
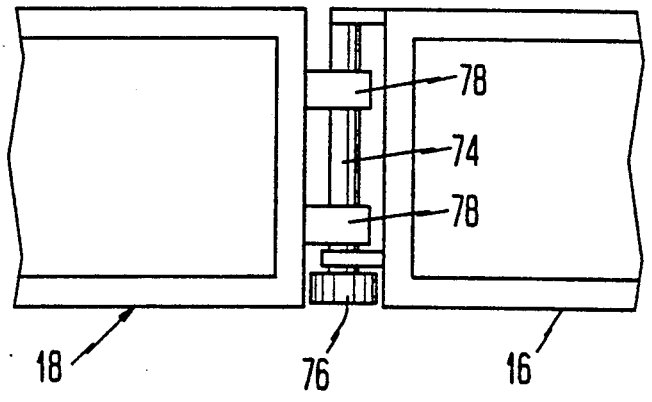

Further features and advantages of the invention are apparent from the following description which in combination with the accompanying drawings explain the invention with respect to exemplary embodiments. The drawings are:

FIG. 1—A schematic side view of an operation with a removable patient support surface means and a battery energized electric motor for adjusting one of the support surface sections, FIG. 2—A view corresponding to FIG. 1 wherein the electric motor is energized by a voltage source located in the support column, FIG. 3—An enlarged schematic illustration of one of the inductive couplings between a voltage source arranged in the support column and an electric utilization device arranged on the patient support surface means, FIG. 4—An enlarged schematic fragmentary view of the electromechanical adjusting drive, and FIG. 5—A plan view of the arrangement of FIG. 4 taken in the direction of the arrow A of FIG. 4.

In FIG. 1 can be seen a schematically illustrated operating table 10 with a support column 12 and a patient support surface means 14. The patient support surface means 14 includes a middle or base section 16 to the ends of which further support surface sections 18 (back portion) and 20 (foot portion) are pivotally connected for movement about horizontal axes 20 and 24, respectively. The middle section 16 has plugs 26 on its underside which are receivable in complementary plug receivers 28 on a support arm 30 of the support column 12. One such operating table is for example known from German Patent 1,196,815. Reference is made to this patent for the explanation of further details.

In the embodiment illustrated in FIG. 1 the adjustment of the support surface sections 18, 20 connected to the base section 16, in the case of each support surface section 18 or 20, is accomplished by means of an electric motor drive unit 32, having an electric motor 34, fastened to the side beam 36 of the support surface section 18. The electric motor 34 is fed by a battery 36 contained in a receiving compartment 40 in the side beam 36. The compartment 40 can be closed by means of a lid 42. The electric motor 34 drives a threaded spindle 44 which is engaged with a nut 46, which nut is pivotally supported for movement about an axis 48 on the base section 16 parallel to the pivot axis 22. Upon rotation of the threaded spindle 44 out of the nut 46 the support surface section 18 is moved out of the position illustrated in FIG. 1 in the direction of the arrow B. The battery 38 ca be taken out of the compartment 40 and can then be replaced by another battery or can be recharged in an external charging device.

The operating table illustrated in FIG. 2 differs from the embodiment illustrated in FIG. 1 only in that the electric motor is fed in a different way. Similar parts are therefore again indicated with the same reference numbers.

The electric motor is connected by conductors 50, 52 to contact elements 54, 56 on the outer sides of the illustrated plug 26, which contact elements, when the patient support surface means 14 rests on the support column 12, make electrical contact with contact elements 58, 60 on the plug receiver 28. The contact elements 58, 60 are connected by conductors 62, 64 with a voltage source 66 which feeds the electric motor 34.

In place of a galvanic coupling according to FIG. 2 an inductive coupling according to FIG. 3 can also be used wherein the voltage source 66 is connected with a primary winding 68 of a transformer 70, whose secondary winding 72 is arranged in the plug 26 and is connected with the electric motor 34 by conductors 50, 52. In place of the electric motor 34 a charging device can be used in FIG. 3 which serves to charge the battery 38 when the patient support surface means 14 rests on the support column 12.

FIGS. 4 and 5 show the mechanical drive connection, between the support surface sections to be adjusted relative to one another, for the case where the electric motor is arranged inside the side beam 36 of one of the support surface sections. In the illustrated embodiment the middle section 16 is rigidly connected with a shaft 74 to which a gear wheel 76 is non-rotatably connected. The gear wheel 76 meshes with the threaded spindle 44 of the electric motor 34 arranged in the side beam 36. The support surface section 18 is pivotally supported on the shaft 74 with the help of tongues 78. A rotation of the spindle 44 in one or the other direction therefore causes the support surface section 18 to be pivoted relative to the middle section 16.

It is to be emphasized that the previously described embodiments represent only examples, which in no way limit the invention claimed by the claims.

I claim:

1. An operating table with a support column (12) and a patient support surface means (14) removably mounted on the support column, which patient support surface means includes a base section (16) releasably connected with the support column (12) at a transition location and which patient support surface also includes at least one further support surface section (18) pivotally connected to the base section, and with a drive mechanism for adjusting the further support surface section (18) relative to the base section (16), characterized in that said drive mechanism is an electric motor drive unit 32 arranged on said patient support surface means (14) including an electric motor (34), and a battery (38) for supplying said electric motor (34) is arranged on said patient support surface means (14).

2. An operating table according to claim 1 further characterized in that said battery is connectable to a charging device separate from the patient support surface means (14) by column sided and support surface sided electric contact elements (58, 60 and 54, 56) situated at said transition location and which contact elements upon placement of the patient support surface means (14) onto the support column (12) come into contact with one another.

3. An operating table according to claim 1 further characterized in that said electric motor drive unit and said battery (38) are arranged on said at least one further support surface section (18) of said patient support surface means (14).

4. An operating table according to claim 1 further characterized in that said battery (38) is bacteriologically tightly sealed.

5. An operating table according to claim 1 further characterized in that said battery (38) is releasably held on said patient support surface means (14).

6. An operating table according to claim 1 further characterized in that said battery (38) is inductively coupled to a column sided voltage source (68) when said patient support surface means (14) rests on said support column (12).

7. An operating table according to claim 1 further characterized in that at least one of said base and further sections (16,18) includes a side beam (36), and in that said electric motor drive unit (32) is arranged inside of said side beam (36).

8. An operating table according to claim 1 further characterized in that at least one of said base and further sections (16, 18) includes a side beam (36), and in that said electric motor drive unit (32) and said battery (38) are arranged inside of said side beam (36).

9. An operating table with a support column (12) and a patient support surface means (14) removably mounted on the support column, which patient support surface means includes a base section (16) releasably connected with the support column (12) and at least one further support surface section (18) pivotally connected to the base section, and with a drive mechanism for adjusting the further support surface section (18) relative to the base section (16), characterized in that said drive mechanism is an electric motor drive unit (32) arranged on said patient support surface means (14) and including an electric motor (34), and in that said electric motor (34) is inductively coupled to a column sided voltage source (68) when said patient support surface means (14) rests on said support column (12).

* * * * *